United States Patent [19]

Newhard, Jr.

[11] 4,131,489

[45] Dec. 26, 1978

[54] CHROMATE CONVERSION COMPOSITION AND METHOD FOR COATING ALUMINUM USING LOW CONCENTRATIONS OF CHROMATE, PHOSPHATE AND FLUORIDE IONS

[75] Inventor: Nelson J. Newhard, Jr., Plymouth Meeting, Pa.

[73] Assignee: Amchem Products, Inc., Ambler, Pa.

[21] Appl. No.: 892,376

[22] Filed: Mar. 31, 1978

[51] Int. Cl.[2] ..... C23F 7/26

[52] U.S. Cl. ..... 148/6.16; 148/6.2; 148/6.27

[58] Field of Search ..... 148/6.16, 6.2, 6.27

[56] References Cited

U.S. PATENT DOCUMENTS

| | | | |
|---|---|---|---|
| 2,438,877 | 3/1948 | Spruance | 148/6.16 |
| 2,494,910 | 1/1950 | Spruance | 148/6.16 |
| 2,928,763 | 3/1960 | Russell | 148/6.16 |
| 3,377,212 | 4/1968 | Newhard | 148/6.16 |
| 3,385,738 | 5/1968 | Russell | 148/6.2 |

FOREIGN PATENT DOCUMENTS

| | | | |
|---|---|---|---|
| 891910 | 3/1962 | United Kingdom | 148/6.16 |

*Primary Examiner*—Ralph S. Kendall

*Attorney, Agent, or Firm*—Dale Lynn Carlson

[57] ABSTRACT

This invention relates to a composition and method for coating aluminum in order to improve both corrosion resistance and paint adhesion. By using very low concentrations of hexavalent chromium ions, phosphate ions and fluoride ions in the coating composition, the characteristics of the treated aluminum surfaces are improved, while process waste disposal problems are minimized.

16 Claims, No Drawings

CHROMATE CONVERSION COMPOSITION AND METHOD FOR COATING ALUMINUM USING LOW CONCENTRATIONS OF CHROMATE, PHOSPHATE AND FLUORIDE IONS

BACKGROUND OF THE INVENTION

It is well known that the aesthetic desirability, corrosion resistance and paint adhesion properties of an aluminum surface may be improved by forming a chromate conversion coating by contacting the surface with an aqueous conversion coating composition containing hexavalent chromium ions, phosphate ions and fluoride ions. By way of illustration, such coatings are disclosed in U.S. Pat. Nos. 2,438,877; 2,928,763 and 3,377,212 and in British Patent Specification No. 891,910.

British Patent Specification No. 891,910 describes a process employing an aluminum coating composition containing 2 to 60 grams/liter of hexavalent chromium ion (calculated as $CrO_3$), 0.15 to 12.5 grams/liter of fluoride ion and 2 to 285 grams/liter of phosphate ion. The pH of the disclosed composition is in the range of from 0.8 to 4.5.

U.S. Pat. No. 2,438,877 describes an aluminum coating process using a coating composition containing 3.75 to 60.0 grams/liter of hexavalent chromium ion (calculated as $CrO_3$), 0.9 to 12.5 grams/liter of fluoride ion and 2 to 285 grams/liter of phosphate ion. The pH of this composition is between about 1.6 and 2.2.

U.S. Pat. No. 2,928,763 discloses an aluminum coating composition consisting essentially of from 2.5 to 62 grams/liter of hexavalent chromium ion (calculated as $CrO_3$), from about 2.5 to 123 grams/liter of fluoride ion, from 5 to 150 grams/liter of phosphate ion, from 1 to 55 grams/liter of aluminum ion, and hydrogen ion. The pH of the composition is disclosed as being between 0.8 and 1.5.

U.S. Pat. No. 3,377,212 discloses an aluminum coating composition containing from 0.1 to 2.4 grams/liter of chromic acid (calculated as $CrO_3$), 0.1 to 1.5 grams/liter of fluoride ion, and 1 to 15 ml./1. of 75% phosphoric acid (corresponding to about 1.2 to 17.8 grams/liter of phosphate ion). The composition disclosed in this patent represents what was heretofore considered to be the minimum concentrations of phosphate, chromate and fluoride ions that would produce an effective aluminum coating.

There has been growing concern in recent years about pollution of rivers and waterways, and attention has been directed to reducing or eliminating harmful materials from the effluent of industrial processes. Hexavalent chromium can cause problems if discharged into waterways because of its strongly oxidizing character. As a result, conventional chromate conversion coating processes have required extensive waste treatment procedures to eliminate possible harmful effects resulting from the discharge of hexavalent chromium. This necessarily results in increased costs, and as a result attention has been given to developing alternative processes for improving the characteristics of aluminum surfaces which employ no hexavalent chromium. In particular, processes have been developed using zirconium based coating compositions. However, these alternative processes have frequently proved more difficult to control with respect to treating solution composition than chromate coating solutions.

OBJECTS

It is an object of the present invention to provide an effective aluminum coating composition consisting essentially of reduced levels of phosphate, chromate and fluoride ions.

It is a further object of the present invention to provide a process for coating aluminum that will produce reduced process waste.

It is yet another object of the present invention to provide an inexpensive process for the coating of aluminum containers and coil stock.

These and other objects will become apparent by a reading of the detailed specification.

SUMMARY OF THE INVENTION

This invention provides a composition for coating the surface of a metal selected from the group consisting of aluminum and alloys thereof in which aluminum is the principal ingredient, comprising an aqueous acidic solution which consists essentially of from about 0.005 to about 0.2 grams/liter of $CrO_3$, from about 0.02 to about 0.4 grams/liter of phosphate ion, and from 0.005 to about 0.04 grams/liter of fluoride ion, the pH of the solution being less than about 3.5.

The invention also provides a process for forming a conversion coating on aluminum surfaces in which the surface to be coated is contacted with the aqueous composition of the invention so as to form the desired coating.

It has been unexpectedly found that by using the compositions of the invention, aluminum surfaces having excellent properties in terms of corrosion resistance and paint adhesion may be obtained, notwithstanding the fact that the coating forming ingredients in the composition are present in amounts considerably below the concentrations used in the prior art compositions. By operating with such low concentrations the problem of waste removal from the coating process is largely overcome, since the concentration of hexavalent chromium in any waste water will be very low and will only require a minimum of treatment to reduce the chromate concentration to within acceptable limits. Moreover, the compositions of the invention lend themselves to being employed in special coating procedures which substantially eliminate the waste water problem, as is shown below.

The coatings of the present invention are useful in the production of aluminum containers (e.g., beer and soda cans) and coil stock.

DETAILED DESCRIPTION OF THE PREFERRED EMBODIMENTS

The essential constituents of the coating composition of the invention are chromate ion ($CrO_3$), phosphate ion and fluoride ion, in the above-specified amounts. The preferred means of providing these constituents is as chromic acid, phosphoric acid and hydrofluoric acid. Although it is possible to employ salts of these acids, such as sodium, potassium, zinc, and copper salts, such a procedure is not recommended since (a) the salts necessarily introduce additional cations into the bath which can interfere with coating formation and reduce the effectiveness of the formed coating and (b) when the salts are employed, it would be necessary to add acid to the salt mixture in order to obtain the desired coating composition pH of less than about 3.5.

The preferred composition within the scope of the invention is one that consists essentially of from about 0.01 to about 0.2 grams/liter of chromic acid (calculated as $CrO_3$), from about 0.04 to about 0.4 grams/liter of phosphoric acid, and from 0.015 to about 0.030 grams/liter of hydrofluoric acid. The most preferred composition is one that consists essentially of 0.1 grams/liter of chromic acid, 0.09 grams/liter of phosphoric acid and 0.02 grams/liter of hydrofluoric acid.

It is to be noted that the above discussion is directed to "unused" coating composition (i.e., the coating bath at "make-up"). After the treatment of aluminum surfaces, some aluminum will go into solution in the composition. In view of the extremely dilute nature of the coating compositions being treated, the amount of aluminum ion will vary from about 0.005 grams/liter or lower to about 20 grams/liter or higher, depending upon the quantity of aluminum being treated. Aluminum, and various other metals such as calcium, form complexes with fluoride ion, and when this happens the "free" (e.g., uncomplexed) fluoride ion content of the composition is reduced even though the total amount of fluoride in the composition remains the same. Since complexed fluoride is not generally available to assist in the formation of a coating, it is therefore important when working with a "used" coating solution to maintain free fluoride ion content within the desired limits either by the addition of fluoride only the dissociation of complexed fluoride. Thus, for a "used" coating composition, the free fluoride ion ranges from about 0.005 to about 0.04 (preferably from about 0.015 to about 0.030) grams/liter.

In practice, as the coating process progresses, fluoride (preferably in the form of hydrofluoric acid) is added to the coating composition in order to maintain the free fluoride ion content within the specified limits. The free fluoride content may be readily determined and monitored by means of any appropriate measuring method such as, for example, the method described in U.S. Pat. No. 3,350,284, incorporated herein by reference.

It is possible to obtain conversion coatings on aluminum using concentrations of chromate, fluoride and phosphate ions in excess of those specified herein, as has been shown in the above prior art discussion. However, in order to obtain effective coating with minimal waste disposal problems, it is necessary to operate within the concentration limits specified herein.

The coating composition and process of this invention is useful in the formation of coatings on pure aluminum and alloys thereof including extrusions, cast, wrought and sintered alloys. Useful alloys include any alloy in which aluminum is the principal ingredient (see, for example, aluminum industry standard numbers 1100, 2014, 3004, 6061 and 7075).

The instant coating composition is an aqueous one having a pH of less than about 3.5. Tap water can be used in forming the composition, and it was found that good results were obtained using a sample of tap water with concentrations of 0.04 grams/liter of chromic acid, 0.35 grams/liter of phosphoric acid and 0.02 grams/liter of hydrofluoric acid. If tap water is used, the composition pH may be affected somewhat, depending upon the nature of the tap water, and therefore a final composition pH check is in order to insure that the pH is less than about 3.5. In this regard, it is possible, although not preferred, to produce the desired acidity by introducing a strong mineral acid such as hydrochloric, sulfuric or nitric acid. In view of the sensitivity of the coating-forming ingredients to the presence of "foreign" ions, it is preferable to use deionized water or "DI water," especially at the lower limits of the concentration levels of the coating-forming ingredients.

A fresh bath for use in accordance with the invention is easily prepared by dilution of a concentrate which includes the essential ingredients in the proper proportion. Illustrative of such an aqueous concentrate is a solution prepared from DI or distilled water containing the following ingredients in the amounts indicated:

$CrO_3$ — 1.0 grams/liter
$H_3PO_4$ — 3.9 grams/liter
HF — 2.0 grams/liter

A typical one percent operational bath made up from such a concentrate using DI or distilled water might contain the essential ingredients in the amounts indicated below:

$CrO_3$ — 0.01 grams/liter
$H_3PO_4$ — 0.039 grams/liter
HF — 0.02 grams/liter

Because certain chemicals are consumed and contaminants introduced into the bath during the coating operation, it is necessary to replenish the bath from time to time to maintain its integrity. Conventional means can be employed to monitor the concentration level of the essential ingredients in the bath. For example, the well known starch-iodimetric titration procedure can be employed to monitor the hexavalent chromium level. Phosphate can be measured by titration using ammonium molydbate reagents. Fluoride concentration can be determined using a device such as Amchem's "Lineguard 101" meter.

In the method of the invention, the aluminum surfaces to be treated are contacted with the coating composition for a time and at a temperature sufficient to produce an effective coating. Suitable contact times range from about 2 to about 40 seconds or longer, preferably from about 10 to about 25 seconds. Suitable coating composition temperatures range from about 15° C. to about 65° C., preferably from about 30° C. to about 40° C. Coating application can be made at atmospheric pressure unless super- or sub-atmospheric pressure is desired form some purpose. The application of the composition to the aluminum surfaces to be treated may be effected by any suitable method known by those skilled in the art, such as, for example, immersion (dipping), spraying and roller coating. Once application of the coating composition to the aluminum surface has begun, the components of the original bath will begin to deplete. A typical concentrated replenishing bath formulation for the preferred composition would be:

$CrO_3$ — 10 grams/liter
$H_3PO_4$ — 30 grams/liter
HF — 6 grams/liter

In a conventional coating process for forming a conversion coating on aluminum surfaces, the surface to be coated is typically subjected to the following sequence of steps:

(a) cleaning;
(b) rinsing;
(c) contacting with a coating-forming composition;
(d) rinsing (optional);
(e) rinsing with deionized water (optional); and
(f) baking.

Following the treatment to form the conversion coating (step c), the surface is optionally rinsed with tap water (step d) and then with DI water (step e). Naturally these rinses, and particularly the first water rinse, become contaminated with excess coating-forming ingredients, and when high concentrations of hexavalent chromium are used the disposal of such rinses poses pollution problems. The present invention reduces this problem significantly since the concentration of hexavalent chromium is so low that build-up of that material to levels at which these problems arise would take a considerable length of time. In this way purification of used rinse water is required much less frequently with a consequent economic saving. Purification of used rinse water can be effected using an ion-exchange resin such as, for example, Rohm & Haas' "Amberlite IRA-94."

EXAMPLES

The following examples are intended to illustrate, but in no way limit, the present invention.

Example 1 — Coating Composition

A coating composition of the invention was prepared having the following composition:

0.1 grams/liter of chromic acid (calculated as $CrO_3$)
0.098 grams/liter of phosphoric acid
0.02 grams/liter of hydrofluoric acid
Deionized water is added to make 1 liter of composition The pH of the composition was 2.59.

Examples 2 to 29 — Formation of Coating On Aluminum Cans Using DI Water Baths Using coatings as given in Table 1, alloy 3004 (beer) aluminum cans were cleaned and coated according to the following procedure:

(a) The cans were prewashed with tap water at 160° F. by spraying at 15 psi for 60 seconds.
(b) The cans were cleaned using a sulfuric acid/fluoride cleaner (≈ 1% by weight in tap water) at 125° F. The amount of fluoride in the cleaner solution was about 20 parts per million.
(c) Some of the cans were then rinsed with tap water.
(d) The cans were spray-treated with the coating composition for 20 seconds at 100° F. and 5 to 6 psig.
(e) The cans were rinsed using DI water copiously applied from a plastic squirt bottle.
(f) The cans were oven baked at 205° C. for 2 minutes.

Sections from the resulting coated cans were then tested as follows:

A. Muffle Test

Sections taken from the sidewalls of the cans were heated in a muffle furnace at 900° F. for 5 minutes. The color of the resulting metal was observed. The presence of a light gold to brown color on the surface of the metal after treatment in the muffle furnace evidences coating formation, whereas the absence of such color ("no color") indicates that a coating was not formed.

B. Blackening Resistance Test

The exterior domes of the cans (i.e., the exterior of the bottom portion of the cans) were boiled in tap water for 15 minutes and then examined for any discoloration of the metal. No darkening should be observed on a can that has been effectively coated.

C. Adhesion Test

Sections of the coated cans were painted with either a white ink or a base coat as follows:

(i) White Ink — A white ink was applied to the coated metal surface. The inked surface was thereafter varnished and then heat cured for 6 minutes at 350° F.
(ii) A white base coat of paint was applied to the coated metal surface using a rollercoat process. The resulting paint layer was cured at 400° C. for 2½ minutes.

The painted can sections were immersed in a boiling 1% (by volume) solution of "Joy" dishwashing detergent in deionized water. The sections were then dried, and portions of the sections were scribed through the coating layers to bare metal. The scribing and taping was performed as follows:

Scribing was done very precisely. A cutting tool was employed to cut parallel lines through the painted surface which were approximately 1½ inches long and 1/16 inch apart. A second set of parallel lines were cut over the first set at a 90 degree angle to produce 100 squares of painted surface, separated by bare metal. "Scotch" tape was applied over the scribed area and pressed firmly onto the metal. The tape was then rapidly peeled off in order to determine the extent of removal of paint or ink coating from the metal surface.

The sections were then assessed for "pickoff" which is removal of discrete pieces and "peel-off" which is removal of the paint or ink as a continuous film.

The results are presented in Table 1. Comparison was made against an untreated can (see "control") and against cans treated with compositions outside of the scope of the instant invention. Note that effective coating was obtained using low $CrO_3$ concentrations of 0.005 grams/liter (see Examples 2 and 3), low concentrations of phosphate ion of 0.020 grams/liter (see Examples 12 and 13), and low concentrations of fluoride ion of 0.008 g./l. (Ex. 20 and 21) with effective coating. The pH range in these examples using deionized water was from 2.59 (see Examples 10 and 11) to 3.09 (see Examples 12 and 13).

The results are presented in Table 1 which follows.

Table 1

| Example | Rinse[1] | $CrO_3$ as g/l Cr | $H_3PO_4$ g/l | HF g/l | pH | Blackening[2] Resistance | Muffle Test | Test - White Ink[2] Adhesion | Test - Base Coat[3] Adhesion |
|---|---|---|---|---|---|---|---|---|---|
| Control | R | — | — | — | — | Poor | No Color | No Pickoff | Fail - Moderate Pickoff |
| Comparison | R | 0.0 | 0.098 | 0.020 | 2.95 | Poor | Light Gold | Slight Pickoff | Fail - Heavy Peel-off |
| Comparison | NR | 0.0 | 0.098 | 0.020 | 2.95 | Poor | Light Gold | Slight to Moderate Pickoff | Fail - Heavy Peeloff |
| 2 | R | 0.005 | 0.098 | 0.020 | 2.93 | Good - ND[4] | Light Gold | No Pickoff | No Pickoff |
| 3 | NR | 0.005 | 0.098 | 0.020 | 2.93 | Good - ND[4] | Light Gold | No Pickoff | No Pickoff |
| 4 | R | 0.010 | 0.098 | 0.020 | 2.90 | Good - ND[4] | Light Gold | No Pickoff | No Pickoff |
| 5 | NR | 0.010 | 0.098 | 0.020 | 2.90 | Good - ND[4] | Light Gold | No Pickoff | No Pickoff |
| 6 | R | 0.020 | 0.098 | 0.020 | 2.86 | Good - ND[4] | Light Gold | No Pickoff | No Pickoff |
| 7 | NR | 0.020 | 0.098 | 0.020 | 2.86 | Good - ND[4] | Light Gold | No Pickoff | No Pickoff |
| 8 | R | 0.050 | 0.098 | 0.020 | 2.74 | Good - ND[4] | Light Gold | No Pickoff | No Pickoff |
| 9 | NR | 0.050 | 0.098 | 0.020 | 2.74 | Good - ND[4] | Light Gold | No Pickoff | No Pickoff |
| 10 | R | 0.100 | 0.098 | 0.020 | 2.59 | Good - ND[4] | Light Gold | No Pickoff | No Pickoff |
| 11 | NR | 0.100 | 0.098 | 0.020 | 2.59 | Good - ND[4] | Light Gold | No Pickoff | No Pickoff |

Table 1-continued

| Example | Rinse[1] | $CrO_3$ as g/l Cr | $H_3PO_4$ g/l | HF g/l | pH | Blackening[2] Resistance | Muffle Test | Test - White Ink[2] Adhesion | Test - Base Coat[3] Adhesion |
|---|---|---|---|---|---|---|---|---|---|
| Comparison | R | 0.0025 | 0.098 | 0.020 | — | Blackened Not Acceptable | Light Gold | No Pickoff | No Pickoff |
| Comparison | NR | 0.0025 | 0.098 | 0.020 | — | Some Blackening - Not Acceptable | Light Gold | No Pickoff | No Pickoff |
| Comparison | R | 0.001 | 0.098 | 0.020 | — | Brownish Not Acceptable | Light Gold | No Pickoff | Slight Pickoff |
| Comparison | NR | 0.001 | 0.098 | 0.020 | — | Brownish Not Acceptable | Light Gold | No Pickoff | Slight Pickoff |
| 12 | R | 0.010 | 0.020 | 0.020 | 3.09 | No Darkening | Light Gold Brown | Pass - No Pickoff | Pass - No Pickoff |
| 13 | NR | 0.010 | 0.020 | 0.020 | 3.09 | No Darkening | Light Gold Brown | Pass - No Pickoff | Pass - No Pickoff |
| 14 | R | 0.010 | 0.039 | 0.020 | 2.99 | No Darkening | Light Gold Brown | Pass - No Pickoff | Pass - No Pickoff |
| 15 | NR | 0.010 | 0.039 | 0.020 | 2.99 | No Darkening | Light Gold Brown | Pass - No Pickoff | Pass - No Pickoff |
| 16 | R | 0.010 | 0.078 | 0.020 | 2.93 | Light Darkening | Light Gold Brown | Pass - No Pickoff | Pass - No Pickoff |
| 17 | NR | 0.010 | 0.078 | 0.020 | 2.93 | Light Darkening | Light Gold Brown | Pass - No Pickoff | Pass - No Pickoff |
| 18 | R | 0.010 | 0.098 | 0.020 | 2.90 | No Darkening | Light Gold Brown | Pass - No Pickoff | Pass - No Pickoff |
| 19 | NR | 0.010 | 0.098 | 0.020 | 2.90 | No Darkening | Light Gold Brown | Pass - No Pickoff | Pass - No Pickoff |
| Comparison | R | 0.020 | 0.039 | 0.0 | 3.13 | Fail - moderate to severe | Very Light Gold | Fail -Massive Peel-off | Fail - Massive Peel-off |
| Comparison | NR | 0.020 | 0.039 | 0.0 | 3.13 | Fail - moderate to severe | Very Light Gold | Mediocre - Slight to Moderate Pickoff | Fail - Moderate Pickoff |
| Comparison | R | 0.020 | 0.039 | 0.004 | 3.04 | Fail - Severe | Gold - brown | Pass - No Pickoff | Pass - No Pickoff |
| Comparison | NR | 0.020 | 0.039 | 0.004 | 3.04 | Fail - moderate to severe | Gold - brown | Pass - No Pickoff | Pass - No Pickoff |
| 20 | R | 0.020 | 0.039 | 0.008 | 3.02 | Mediocre - mild blackening | Gold - brown | Pass - No Pickoff | Pass - No Pickoff |
| 21 | NR | 0.020 | 0.039 | 0.008 | 3.02 | Pass - slight darkening | Gold - brown | Pass - No Pickoff | Pass - No Pickoff |
| 22 | R | 0.020 | 0.039 | 0.016 | 2.94 | Pass - no darkening | Gold - brown | Pass - No Pickoff | Pass - No Pickoff |
| 23 | NR | 0.020 | 0.039 | 0.016 | 2.94 | Pass - no darkening | Gold - brown | Pass - No Pickoff | Pass - No Pickoff |
| 24 | R | 0.020 | 0.039 | 0.020 | 2.98 | Pass - no darkening | Gold - brown | Pass - No Pickoff | Pass - No Pickoff |
| 25 | NR | 0.020 | 0.039 | 0.020 | 2.98 | Pass - no darkening | Gold - brown | Pass - No Pickoff | Pass - No Pickoff |
| Comparison | R | 0.050 | 0.098 | 0.0 | 2.77 | Fail - severe | Light gold brown | Fail - Moderate Pickoff | Fail - Massive Pickoff |
| Comparison | NR | 0.050 | 0.098 | 0.0 | 2.77 | Fail - severe | Gold - brown | Pass - No Pickoff | Pass - No Pickoff |
| Comparison | R | 0.050 | 0.098 | 0.004 | 2.73 | Fail - severe | Gold - brown | Pass - No Pickoff | Pass - No Pickoff |
| Comparison | NR | 0.050 | 0.098 | 0.004 | 2.73 | Pass - no darkening | Gold - brown | Pass - No Pickoff | Pass - No Pickoff |
| Comparison | R | 0.050 | 0.098 | 0.008 | 2.70 | Mediocre - mild blackening | Gold - brown | Pass - No Pickoff | Pass - No Pickoff |
| Comparison | NR | 0.050 | 0.098 | 0.008 | 2.70 | Pass - no darkening | Gold - brown | Pass - No Pickoff | Pass - No Pickoff |
| 26 | R | 0.050 | 0.098 | 0.016 | 2.74 | Pass - mild darkening | Gold - brown | Pass - No Pickoff | Pass - No Pickoff |
| 27 | NR | 0.050 | 0.098 | 0.016 | 2.74 | Pass - no darkening | Gold - brown | Pass - No Pickoff | Pass - No Pickoff |
| 28 | R | 0.050 | 0.098 | 0.020 | 2.72 | Pass - no darkening | Gold - brown | Pass - No Pickoff | Pass - No Pickoff |
| 29 | NR | 0.050 | 0.098 | 0.020 | 2.72 | Pass - no darkening | Gold - brown | Pass - No Pickoff | Pass - No Pickoff |

[1]"R" denotes rinse, "NR" indicates that no rinse was employed between coating formation and baking.
[2]Average of three runs.
[3]Average of two runs.
[4]"ND" denotes no darkening.

Examples 30 to 37 — Formation of Conversion Coatings on Aluminum Cans — Tap Water Compositions The testing procedures described for Examples 2 to 27 were carried out on a series of coating compositions made up in tap water. The results obtained are given in Table 2 which follows.

It will be noted that higher concentrations of the coating-forming materials were generally employed to obtain satisfactory coating, but that these concentrations were still significantly lower than those used in prior art processes. The pH of these compositions in tap water ranged from 2.66 (see Examples 34 and 35) to 3.20 (see Examples 32 and 33).

Table 2

| Example | Rinse[1] | $CrO_3$ as g/l Cr | $H_3PO_4$ g/l | HF g/l | pH | Blackening[2] Resistance | Muffle Test | Test - White Ink[2] Adhesion | Test - Base Coat[3] Adhesion |
|---|---|---|---|---|---|---|---|---|---|
| 30 | R | 0.050 | 0.392 | 0.020 | 2.77 | Some darkening | Gold - brown | Pass - No Pickoff | Pass - No Pickoff |
| 31 | NR | 0.050 | 0.392 | 0.020 | 2.77 | No darkening | Gold - brown | Pass - No Pickoff | Pass - No Pickoff |
| 32 | R | 0.100 | 0.098 | 0.020 | 3.20 | No darkening | Gold - brown | Pass - No Pickoff | Pass - No Pickoff |
| 33 | NR | 0.100 | 0.098 | 0.020 | 3.20 | No darkening | Gold - brown | Pass - No Pickoff | Pass - No Pickoff |
| 34 | R | 0.100 | 0.392 | 0.020 | 2.66 | No darkening | Gold - brown | Pass - No Pickoff | Pass - No Pickoff |
| 35 | NR | 0.100 | 0.392 | 0.020 | 2.66 | No darkening | Gold - brown | Pass - No Pickoff | Pass - No Pickoff |
| 36 | R | 0.020 | 0.392 | 0.040 | 2.84 | Slight darkening | Gold - brown | Pass - No Pickoff | Pass - No Pickoff |
| 37 | NR | 0.020 | 0.392 | 0.040 | 2.84 | No darkening | Gold - brown | Pass - No Pickoff | Pass - No Pickoff |

[1]"R" denotes rinse, "NR" indicates that no rinse was employed between coating formation and baking.
[2]Average of three runs.
[3]Average of two runs.

What is claimed is:

1. An aqueous acidic solution, for coating the surface of a metal selected from the group consisting of aluminum and alloys thereof in which aluminum is the principal ingredient, which consists essentially of from about 0.005 to about 0.2 grams/liter of $CrO_3$, from about 0.02 to to about 0.4 grams/liter of phosphate ion, and from about 0.005 to about 0.04 grams/liter of fluoride ion, the pH of the solution being less than about 3.5.

2. An aqueous acidic solution, for coating the surface of a metal selected from the group consisting of aluminum and alloys thereof in which aluminum is the principal ingredient, which consists essentially of from about 0.01 to about 0.2 grams/liter of chromic acid (calculated as $CrO_3$), from about 0.04 to about 0.4 grams/liter of phosphoric acid, and from about 0.015 to about 0.030 grams/liter of hydrofluoric acid, the pH of the solution being less than about 3.5.

3. The solution as claimed in claim 2 wherein the chromic acid is present in an amount of 0.1 grams/liter, the phosphoric acid is present in an amount of 0.09 grams/liter, and the hydrofluoric acid is present in an amount of 0.02 grams/liter.

4. A "used" aqueous acidic solution, for coating the surface of a metal selected from the group consisting of aluminum and alloys thereof in which aluminum is the principal ingrediet, which consists essentially of from about 0.005 to about 20 grams/liter of aluminum ion, from about 0.005 to about 0.2 grams/liter of $CrO_3$, from about 0.02 to about 0.4 grams/liter of phosphate ion, and from about 0.005 to about 0.04 grams/liter of free fluoride ion, the pH of the solution being less than about 3.5.

5. A "used" aqueous acidic solution for coating the surface of a metal selected from the group consisting of aluminum and alloys thereof in which aluminum is the principal ingredient, which consists essentially of from about 0.005 to about 20 grams/liter of aluminum ion, from about 0.01 to about 0.2 grams/liter of chromic acid (calculated as $CrO_3$), from about 0.04 to about 0.4 grams/liter of phosphoric acid, and from about 0.015 to about 0.030 grams/liter of free fluoride ion, the pH of the solution being less than about 3.5.

6. The solution as claimed in claim 5 wherein the chromic acid is present in an amount of 0.1 grams/liter, the phosphoric acid is present in an amount of 0.09 grams/liter, and the free fluoride ion is present in an amount of 0.02 grams/liter.

7. A process for coating the surface of a metal selected from the group consisting of aluminum and alloys thereof in which aluminum is the principal ingredient, which comprises the step of contacting the surface of said metal with an aqueous acidic solution consisting essentially of from about 0.005 to about 0.2 grams/liter of $CrO_3$, from about 0.2 to about 0.4 grams/liter of phosphate ion, and from about 0.005 to about 0.04 grams/liter of fluoride ion, the pH of the solution being less than about 3.5.

8. The coating produced by the process of claim 7.

9. A process for coating the surface of a metal selected from the group consisting of aluminum and alloys thereof in which aluminum is the principal ingredient, which comprises the step of contacting the surface of said metal with an aqueous acidic solution consisting essentially of from about 0.01 to about 0.2 grams/liter of chromic acid (calculated as $CrO_3$), from about 0.04 to about 0.4 grams/liter of phosphoric acid, and from about 0.015 to about 0.030 grams/liter of hydrofluoric acid, the pH of the solution being less than about 3.5.

10. The coating produced by the process of claim 9.

11. The process as claimed in claim 9 wherein the chromic acid is present in an amount of 0.1 grams/liter, the phosphoric acid is present in an amount of 0.09 grams/liter and the hydrofluoric acid is present in an amount of 0.02 grams/liter.

12. The coating produced by the process of claim 11.

13. A process for coating the surface of a metal selected from the group consisting of aluminum and alloys thereof in which aluminum is the princiapl ingredient, which comprises the step of contacting the surface of said metal with a "used" aqueous acidic solution consisting essentially of from about 0.005 to about 20 grams/liter of aluminum ion, from about 0.005 to about 0.2 grams/liter of $CrO_3$, from about 0.02 to about 0.4 grams/liter of phosphate ion, and from about 0.005 to about 0.04 grams/liter of free fluoride ion, the pH of the solution being less than about 3.5.

14. The coating produced by the process of claim 13.

15. A process for coating the surface of a metal selected from the group consisting of aluminum and alloys thereof in which aluminum is the principal ingredient, which comprises the step of contacting the surface of said metal with a "used" aqueous acidic solution consisting essentially of from about 0.005 to about 20 grams/liter of aluminum ion, from about 0.01 to about 0.2 grams/liter of chromic acid (calculated as $CrO_3$), from about 0.04 to about 0.4 grams/liter of phosphoric acid, and from about 0.015 to about 0.030 grams/liter of free fluoride ion, the pH of the solution being less than about 3.5.

16. The coating produced by the process of claim 15.

* * * * *

UNITED STATES PATENT AND TRADEMARK OFFICE

CERTIFICATE OF CORRECTION

PATENT NO. : 4,131,489

DATED : December 26, 1978

INVENTOR(S) : Nelson J. Newhard, Jr.

It is certified that error appears in the above-identified patent and that said Letters Patent are hereby corrected as shown below:

Column 3, line 28, "only" should read --or by--.

Column 4, line 44, "form" should read --for--.

Column 9, line 45, correct the spelling of "ingredient".

Signed and Sealed this

*Twenty-fifth* Day of *November 1980*

[SEAL]

*Attest:*

SIDNEY A. DIAMOND

*Attesting Officer*

*Commissioner of Patents and Trademarks*